United States Patent [19]

Tuneblom

[11] 4,342,485

[45] Aug. 3, 1982

[54] COLD SURFACE PLANER COOLING APPARATUS

[75] Inventor: Eskil Tuneblom, Mount Arlington, N.J.

[73] Assignee: Dynapac Maskin AB, Solna, Sweden

[21] Appl. No.: 182,430

[22] Filed: Aug. 29, 1980

[51] Int. Cl.[3] ..... E01C 23/09

[52] U.S. Cl. ..... 299/39; 299/89

[58] Field of Search ..... 299/39, 76, 78, 89; 404/117, 121

[56] References Cited

U.S. PATENT DOCUMENTS

| | | | |
|---|---|---|---|
| 2,248,478 | 7/1941 | Mall | 404/117 |
| 2,541,007 | 2/1951 | Small | 404/121 |
| 3,052,166 | 9/1962 | Thrun | 404/117 |
| 3,362,753 | 1/1968 | Sibley | 299/76 X |
| 3,722,381 | 3/1973 | Tuneblom | 404/117 |
| 4,162,104 | 7/1979 | Kogler et al. | 299/89 X |

*Primary Examiner*—Ernest R. Purser

*Attorney, Agent, or Firm*—Brumbaugh, Graves, Donohue & Raymond

[57] ABSTRACT

A cold surface pavement planer, used to scarify and profile concrete and asphaltic pavements, is constructed with a sealed cutter drum. A gear box in the cutter drum, transmitting power to the cutter drum from an engine on the planer chassis, is cooled efficiently by a coolant liquid in the cutter drum in which the gear box is partially immersed.

3 Claims, 2 Drawing Figures

COLD SURFACE PLANER COOLING APPARATUS

The present invention relates to cooling a gear box enclosed in a cold surface planer cutter drum.

BACKGROUND OF THE INVENTION

Cold surface pavement planers have been used to scarify and profile concrete and asphaltic pavements. To accomplish this function, a movable chassis supports a rotatable cutter drum. An engine on the chassis is used to drive the cutter drum as well as move the chassis and power other auxiliaries. To reduce the speed of the engine and provide power for the cutter drum, a gear box is located within the drum, and a coupling provided between the engine and the gear box.

Since the cutter drum must rotate slowly, a substantial reduction in speed is provided by the gear box, and the power losses in the gear box, which operates at an efficiency of about 90%, cause considerable heating of the box.

In the past, the surfaces of the gear box exposed to air in the drum dissipated heat by means of convection into the air, and then through the drum surface. This inefficient heat transfer caused significant heating problems and often overheating of the gear box.

SUMMARY OF THE INVENTION

The present invention provides for efficient cooling of the gear box found in cold surface pavement planers. To achieve this result, the cutter drum is constructed to be leak-proof, and a coolant liquid placed in the drum, partially immersing the gear box in the coolant. With this arrangement, heat from the gear box is efficiently transmitted to the large surface of the cutter drum via the coolant. The heat is then transmitted into the atmosphere and the material cut by the drum.

The invention will be better understood when reference is made to the following detailed description of a preferred embodiment taken in connection with the accompanying drawings.

DETAILED DESCRIPTION OF THE PREFERRED EMBODIMENT

Figure 1:
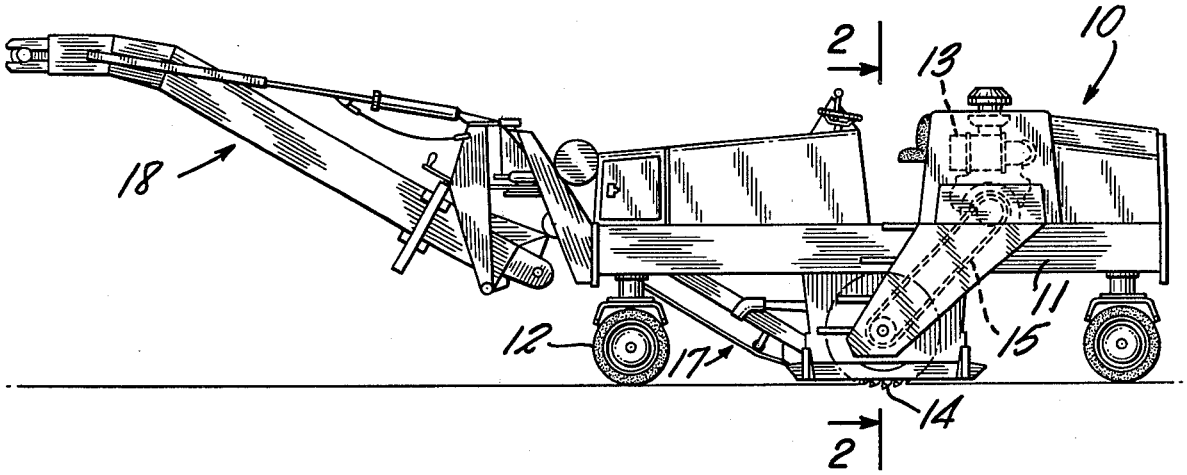
FIG. 1 is a view in elevation of a cold surface pavement planer embodying the cooling apparatus of the present invention.
Figure 2:
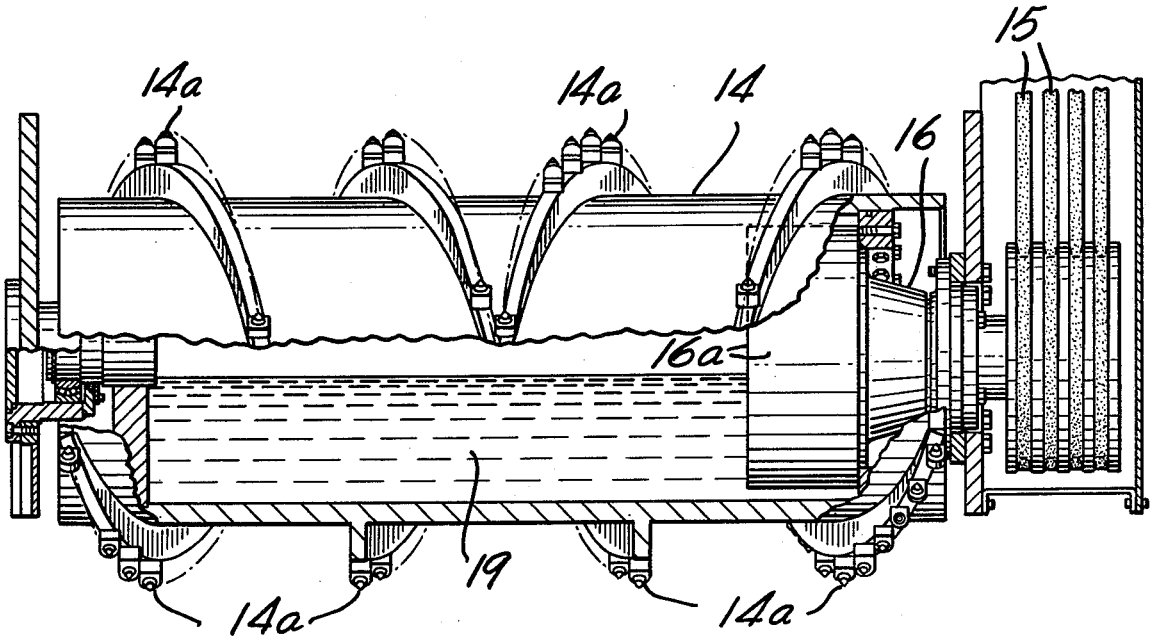
FIG. 2 is an enlarged cross-sectional view of the cutter drum of the cold planer of FIG. 1 taken along the view line 2—2 looking in the direction of the arrows.

Referring to the invention in greater detail with particular reference to FIGS. 1 and 2, a cold surface pavement planer 10 includes a chassis 11 mounted on wheels 12. An engine 13 carried by the chassis, drives, preferably through an on-off clutch (not shown), a cutter drum 14 through a belt coupling 15 and a final drive planetary gear box 16. The engine also is selectively coupled to the wheels 12 to move the chassis 11, and provides power for other auxiliary functions of the cold surface planer.

Hardened cutting teeth 14*a* on the drum 14 function to scarify and profile concrete and asphaltic pavement. A conveyor, generally indicated at 17 and 18, serves to transport material cut from the pavement for discharge to a truck (not shown).

The cutter drum 14 is formed to be liquid-tight, i.e., sealed, and coolant liquid 19 is introduced into the drum through a convenient sealable opening (not shown). Preferably the drum is about half full of coolant partially to immerse the gear box 16 in the coolant. In the interests of cooling efficiency and ability to operate in cold weather, a coolant comprised of a suitable mixture of ethylene glycol and water can be used in the cutter drum 14.

In a typical cold surface planer, a 380 hp Diesel engine runs at 2100 rpm. Most of the engine's power, about 300 hp., is used to drive the cutter drum 14, the remaining power being employed to move the cold planer and for auxiliaries including the conveyor 17 and 18. The cutter drum 14, typically equipped with on the order of 134 cutting teeth having tungsten carbide tips, in an exemplary unit, is rotated at a speed of 81 rpm for best productivity and the least amount of tooth wear.

To reduce the engine speed of 2100 rpm to 81 rpm, the gear box 16 can be a planetary gear box, for example, a TORQUE HUB Model W20D Series, manufactured and sold by Fairfield Manufacturing of Lafayette, Indiana.

The gear box 16 operates at a total efficiency of about 90%. With a power transmission of 300 hp, a loss of 30 hp is transformed into heat which appears primarily at surfaces 16*a* of the gear box 16. In prior art cold planers, air convection cooling of the gear box led to significant overheating. With the gear box 16 partially immersed in the coolant 19, heat is efficiently transferred from the surfaces 16*a* to the cutter drum surface, and then to the atmosphere and material the drum is cutting.

With use of the inventive cooling apparatus, the gear box runs cool and efficiently, requires fewer oil changes, and has a lengthened service life.

I claim:

1. In a cold surface pavement planer having a movable chassis supporting a rotatable cutter drum, a gear box for driving said drum having a gear box housing disposed in the drum, an engine mounted on the chassis, and a coupling between the engine and the gear box, the improvement comprising a liquid coolant in the cutter drum, wherein the gear box housing has an outside surface partially immersed in the coolant, so that heat generated by power losses in the gear box is transmitted from said outside surface of said gear box housing to the drum surface by the coolant in the drum.

2. A cold surface pavement planer according to claim 1, wherein the coolant is a mixture of ethylene glycol and water.

3. A cold surface pavement planer according to claim 1 or 2, wherein the gear box is a planetary gear box.

* * * * *